US005131309A

United States Patent [19]

Nishikawa et al.

[11] Patent Number: 5,131,309

[45] Date of Patent: Jul. 21, 1992

[54] PERFORMANCE RECORDING/REPRODUCING APPARATUS ENABLING CORRECTION OR MODIFICATION OF PLAYING INFORMATION

[75] Inventors: Hiroshi Nishikawa, Nagoya; Akinari Inoue, Kasugai, both of Japan

[73] Assignee: Brother Kogyo Kabushiki Kaisha, Nagoya, Japan

[21] Appl. No.: 524,745

[22] Filed: May 17, 1990

[30] Foreign Application Priority Data

May 29, 1989 [JP] Japan ..... 1-135130

[51] Int. Cl.[5] ..... G10G 3/04

[52] U.S. Cl. ..... 84/601; 84/DIG. 29; 84/641; 84/642; 84/462

[58] Field of Search ..... 84/601, 602, 645, 641, 84/642, DIG. 29, 609, 610, 611, 612, 613, 614, 634-638, 462, 642

[56] References Cited

U.S. PATENT DOCUMENTS 3,781,452 12/1973 Vauclain ..... 84/DIG. 29
4,487,101 12/1984 Ellen ..... 84/462
4,587,878 5/1986 Nakada et al. ..... 84/DIG. 29
4,694,724 9/1987 Kikumoto et al. ..... 84/642
4,744,281 5/1988 Isozaki et al. ..... 84/602
4,788,896 12/1988 Uchiyama et al. ..... 84/624
4,899,632 2/1990 Okamura ..... 84/601
4,901,616 2/1990 Matsubara et al. ..... 84/602
4,942,551 7/1990 Klappert et al. ..... 84/645

FOREIGN PATENT DOCUMENTS 63-193193 8/1988 Japan .

*Primary Examiner*—William M. Shoop, Jr.
*Assistant Examiner*—Helen Kim
*Attorney, Agent, or Firm*—Oliff & Berridge

[57] ABSTRACT

The invention provides a performance recording/reproducing apparatus including a playing information recording device, a data discrimination device and a data transfer device. The data discrimination device discriminates a specific channel of playing data, which needs correction or modification from the others all merged on one of the tracks of the playing information recording device. The data transfer device transfers data of the specific channel to another track. The apparatus thus efficiently corrects or modifies only data of the specific channel and accordingly completes recording of performance in a short while.

20 Claims, 7 Drawing Sheets

RECORDING TRACK (RT)
MERGE TRACK (MT)
10
T1
ch1
T2
ch1
T3
ch1
. . . .

RT
MT ch2

PERFORMANCE RECORDING/REPRODUCING APPARATUS ENABLING CORRECTION OR MODIFICATION OF PLAYING INFORMATION

BACKGROUND OF THE INVENTION

This invention relates to performance recording/reproducing apparatus for recording and reproducing information for controlling electronic instruments to generate music.

Performance recording/reproducing apparatus utilizing playing information of an MIDI (musical instrument digital interface) have been proposed in, for example, Japanese Published Unexamined Patent Application No. Sho-63-193193. The apparatus records playing information input from a keyboard of an electronic instrument or a computer in the form of digital event data showing the operation of keys on the keyboard and reproduces the playing information to output it to a computer or any other sound sources.

In the general performance recording/reproducing apparatus above, each channel consists of playing information input from each of plural electronic instruments; that is, each channel is assigned to playing information for an electronic instrument. The playing information is generally recorded on a recording track or a merge track set in a memory of the performance recording/reproducing apparatus with corresponding time data.

A performance of music is recorded in the following steps. A channel of playing information sent from an electronic instrument is recorded on a recording track. The playing information on the recording track is reproduced, checked, and then transferred to a merge track. A channel of playing information for another electronic instrument is recorded on the recording track, reproduced, checked, and then merged with the information on the merge track. In the above manner, plural channels of playing information are successively transferred to the merge track to be merged thereon; the whole performance of music is thus completed.

The above method, however, gives great inconvenience and trouble when some correction or modification is required for only part of the playing information merged on the merge track. Once plural channels of playing information are merged on the merge track, it is impossible to pick up only a specific channel of playing information to be corrected or modified. Correction or modification of playing information thus means performance of music from the beginning once again. It accordingly takes time to complete recording of performance.

SUMMARY OF THE INVENTION

One objective of the invention is thus to provide a performance recording/reproducing apparatus for recording a performance easily and rapidly.

Another objective of the invention is to provide a performance recording/reproducing apparatus in which part of playing data is efficiently corrected or modified.

The above and other related objectives are realized by a performance recording/reproducing apparatus, shown in FIG. 1, for recording event data for an electronic instrument M1 as plural channels of playing information on one of tracks of playing information recording means M2 and for reproducing the event data recorded. The performance recording/reproducing apparatus includes data discrimination means M3 for discriminating a specific channel of playing information from the other channels of playing information all merged on one of the tracks of the playing information recording means M2. The performance recording/reproducing apparatus further includes data transfer means M4 for transferring playing information of the specific channel discriminated by the data discrimination means M3 from the track storing the playing information to another track.

The performance recording/reproducing apparatus of the invention records event data for the electronic instrument M1 as plural channels of playing information on one of the tracks of the playing information recording means M2 and then reproduces the event data recorded. The data discrimination means M3 discriminates a specific channel of playing information, which needs correction or modification from the other channels of playing information all merged on one of the tracks of the playing information recording means M2. The data transfer means M4 transfers playing information of the specific channel discriminated by the data discrimination means M3 from the track storing the playing information to another track. The apparatus thus efficiently corrects or modifies only playing information of the specific channel transferred and accordingly completes recording of performance in a short while.

BRIEF DESCRIPTION OF THE DRAWINGS

The invention may be best understood by referring to the following detailed description of the preferred embodiment and the accompanying drawings, wherein like numerals denote like elements and in which:

FIG. 1 is a schematic view illustrating a system including an MIDI sequencer and a keyboard, embodying the invention;

DETAILED DESCRIPTION OF PREFERRED EMBODIMENTS

Figure 1:
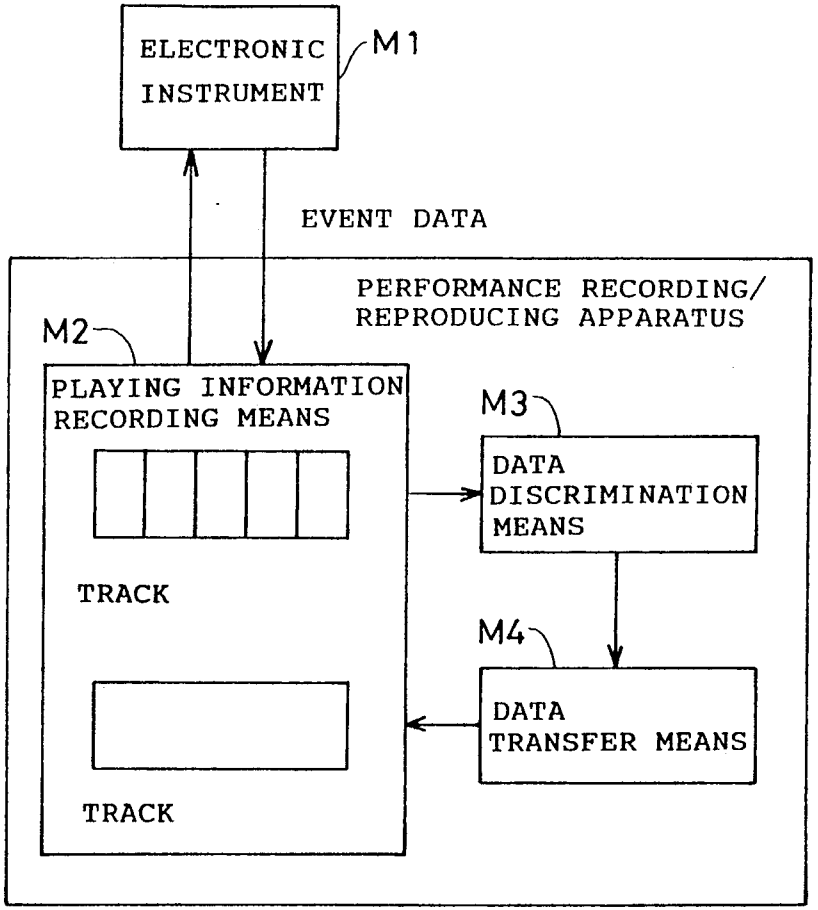
FIG. 1 is a block diagram showing features of the invention.

A preferred embodiment of the invention is now described referring to the drawings.

Figure 2:
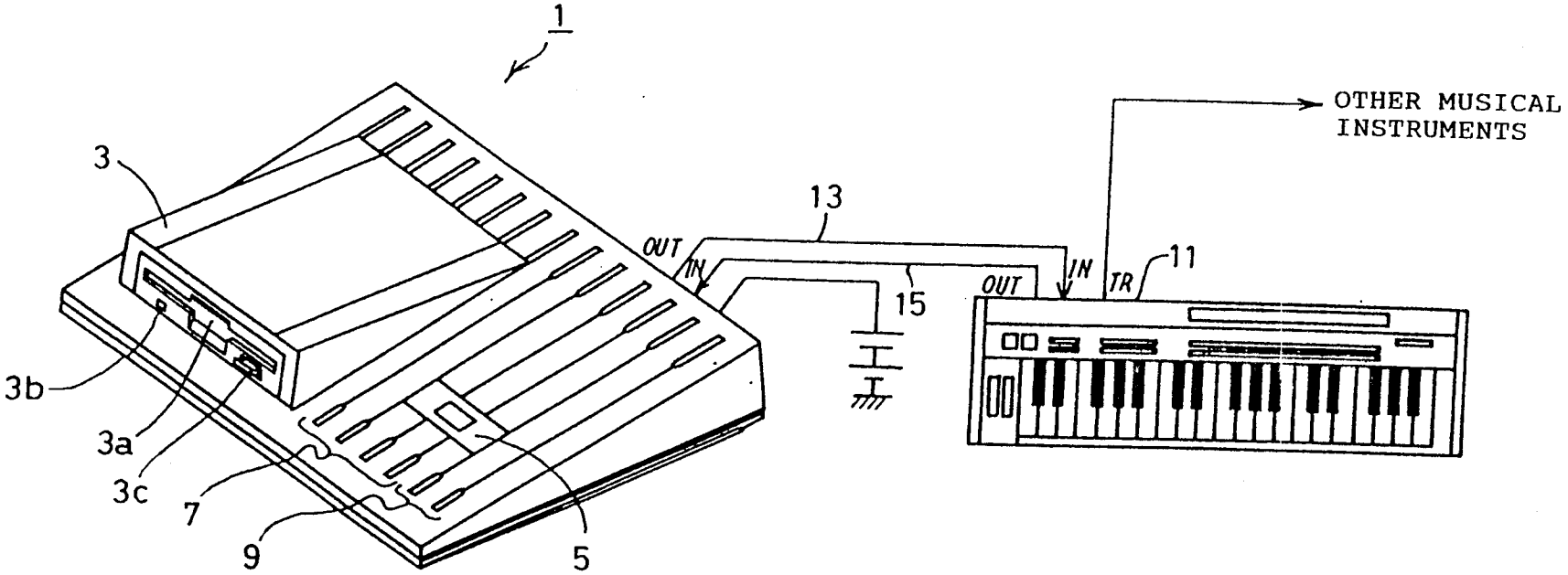

As shown in FIG. 2, an MIDI sequencer 1 includes a floppy disk unit 3, a liquid crystal display (hereinafter referred to as LCD) 5, function keys 7 and shift keys 9. The floppy disk unit 3 records and stores information for playing music including event data and time data into a recording medium or a floppy disk and then reproduces the information stored. The floppy disk unit 3 has a slot 3*a* in which a floppy disk is inserted, an access lamp 3*b* for indicating that the unit is recording or reproducing, and an eject button 3c for ejecting a floppy disk.

The MIDI sequencer 1 is connected to a keyboard 11 of an electronic instrument through MIDI signal cables 13 and 15. The sequencer 1 receives event data from the keyboard 11 and stores the event data together with time data showing the time of the reception as playing information; the sequencer also outputs event data corresponding to time data to the keyboard 11 or another musical instrument to make it sound. The keyboard 11 distributes event data sent from the MIDI sequencer 1 to other electronic instruments.

Figure 3:
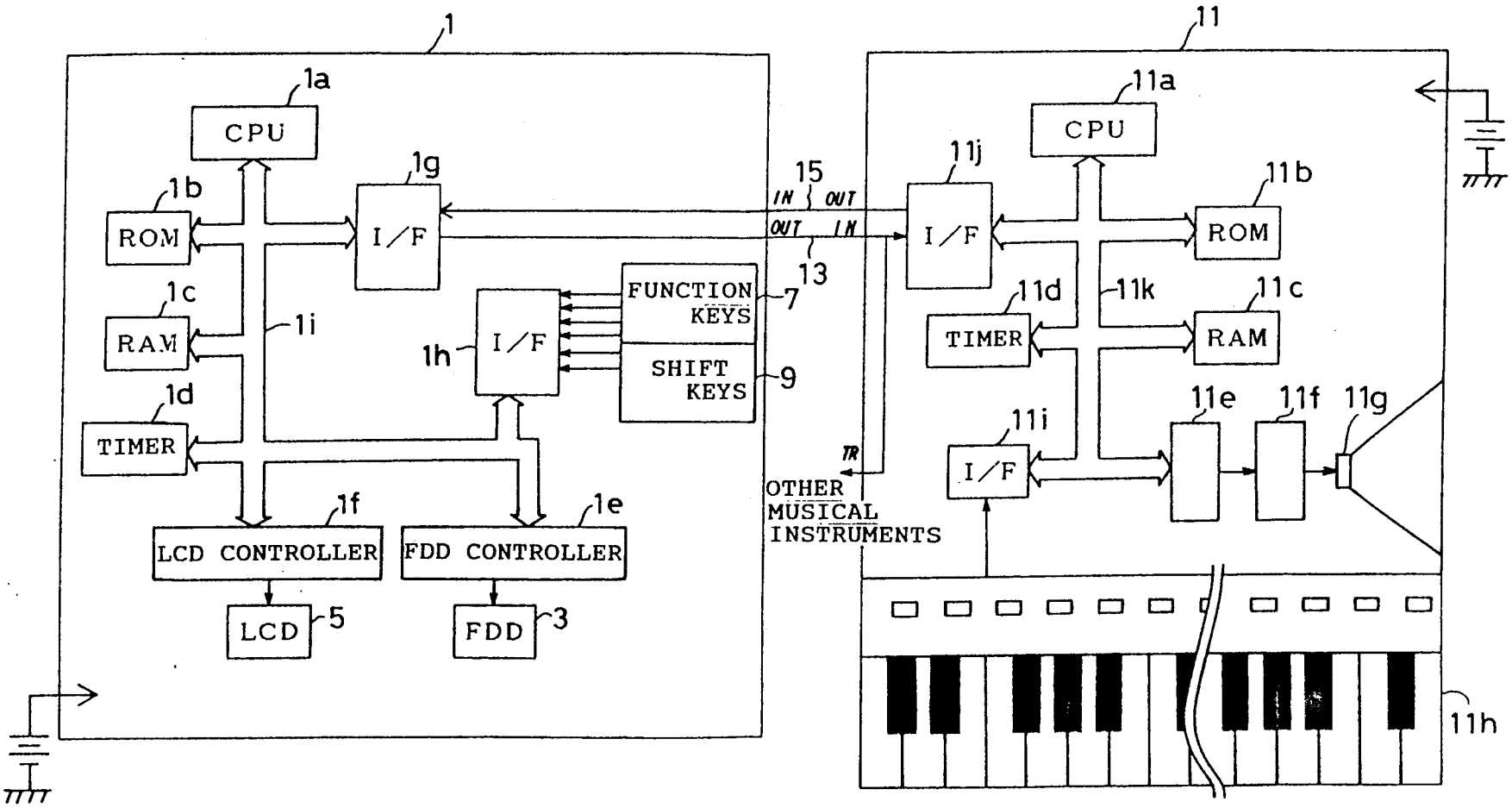
FIG. 3 is a block diagram showing the structure of the MIDI sequencer and the keyboard of FIG. 2.

FIG. 3 is a block diagram showing the signal processing system. The MIDI sequencer 1 has a central processing unit (hereinafter referred to as CPU) 1*a*, a read only memory (hereinafter referred to as ROM) 1*b*, a random access memory (hereinafter referred to as RAM) 1*c* and a timer 1*d*, which compose a digital computer. The MIDI sequencer 1 further includes a floppy disk controller le for driving and controlling the floppy disk unit 3, an LCD controller 1*f* for driving and controlling the LCD 5, an interface 1*g* for inputting and outputting event data in sequence, an input interface 1*h* for the keys 7 and 9, and a bus line 1*i* for connecting them to one another to transmit various signals.

The keyboard 11 also has a CPU 11*a*, a ROM 11*b*, a RAM 11*c* and a timer 11*d*, which compose a digital computer. The keyboard 11 further includes a sound source 11*e* for converting digital event data into analog sound signal, an amplifier 11*f* for amplifying the analog sound signal, a speaker 11*g* for generating the amplified sound signal, an interface 11*i* for keys 11*h*, an interface 11*j* for inputting and outputting event data in sequence, and a bus line 11*k* for connecting them to one another to transmit various signals.

Figure 4A:
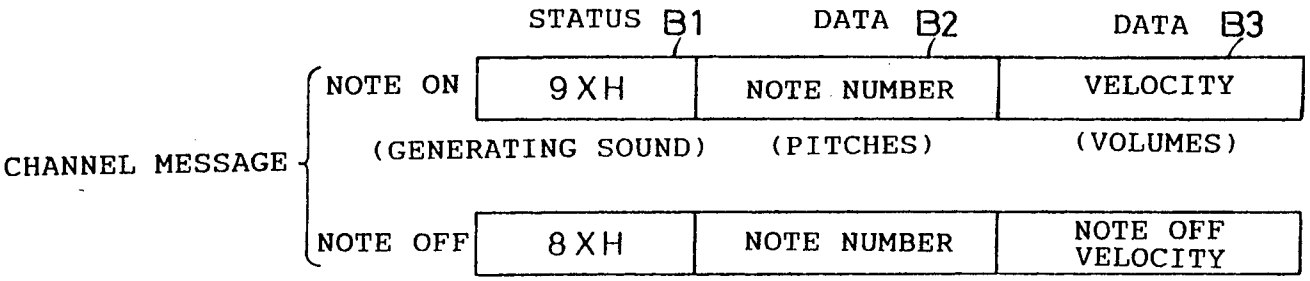
FIGS. 4A and 4B are views illustrating contents of playing information.
Figure 4B:
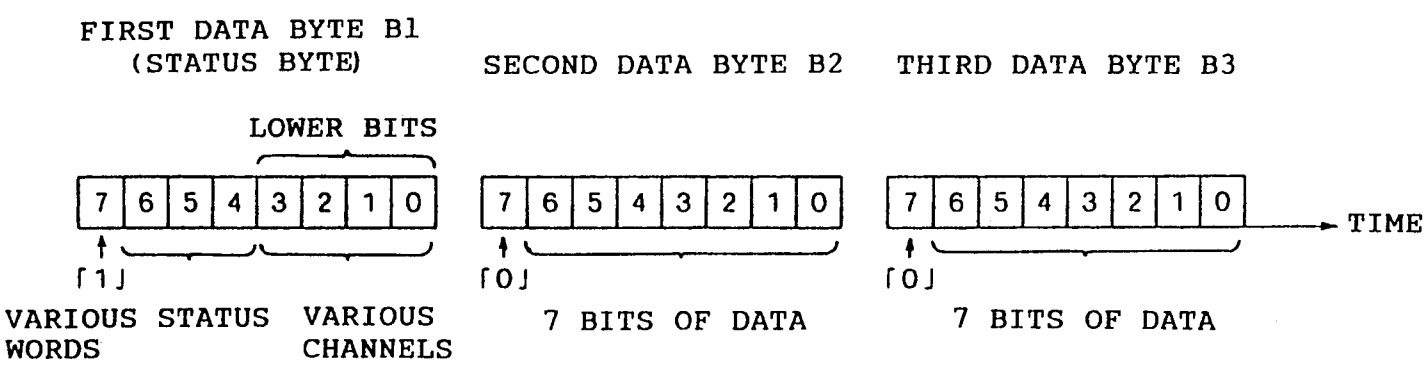

Playing information processed in the MIDI sequencer 1 is explained based on views of FIGS. 4A and 4B.

The MIDI sequencer 1 for processing MIDI playing information records key event data in the RAM 1*b* together with time data and then reproduces and outputs the key event data corresponding to the time data recorded. Here the key event data shows pressing on and off of the keys llh (what is called 'note on' and 'note off') and the time data shows the time when the key event data is generated.

Playing information includes a channel message for each of the plural channels, where each channel is assigned to an electronic instrument, and a system message for the system as a whole. The channel message includes, as shown in FIG. 4A, 'note on' and 'note off' information. Each unit of the 'note on' or 'note off' information generally consists of three bytes: a status byte or a first data byte B1 for executing operation, e.g., generating sound, and discriminating a specific channel from others; a note number byte or a second data byte B2 for determining pitches of sound; and a velocity byte or a third data byte B3 for determining volumes of sound. In FIG. 4A, X denotes a channel number and H indicates that data is expressed by hexadecimal notation.

As seen in FIG. 4B, the seventh bit of the first data byte B1 is '1'; the number establishes the identity of the first data byte B1. The sixth through the fourth bits indicate various status words like 'note on'; that is, they are code data for operation. The third through the null bits indicate various channels; that is, they are code data for discriminating a specific channel from others. Combinations of digits on the status byte B1 give eight different status words and sixteen different channels. Status words other than 'note on' include polyphonic key pressure, control change, and program change.

Each seventh bit of the second data byte B2 and the third data byte B3 is '0'; the number establishes the identity of the data byte B2 or B3. The lower seven bits of B2 and B3 are operational code data indicating a hundred twenty eight different pitches and volumes, respectively.

Figures 5A, 5B, 5C, 5D:
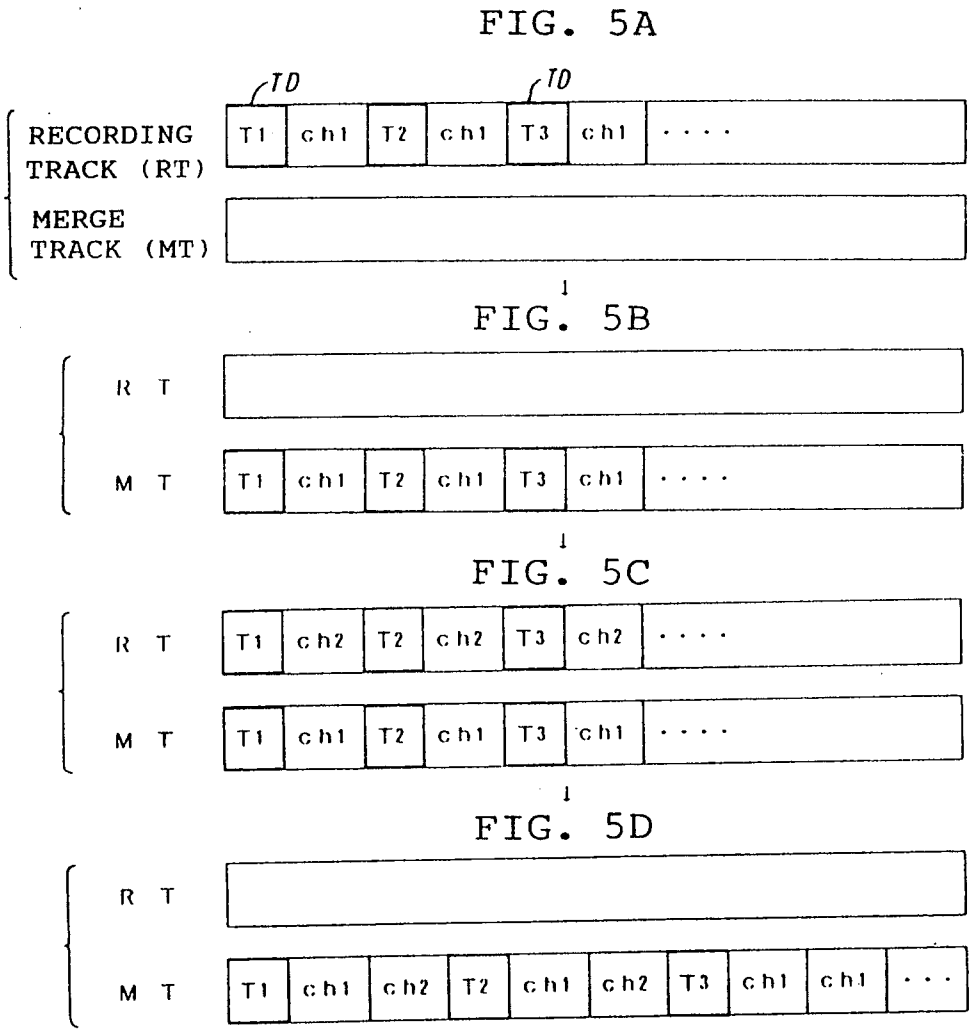
FIGS. 5A through 5D are views showing processes for recording playing information on tracks.
Figures 6A, 6B, 6C, 6D:
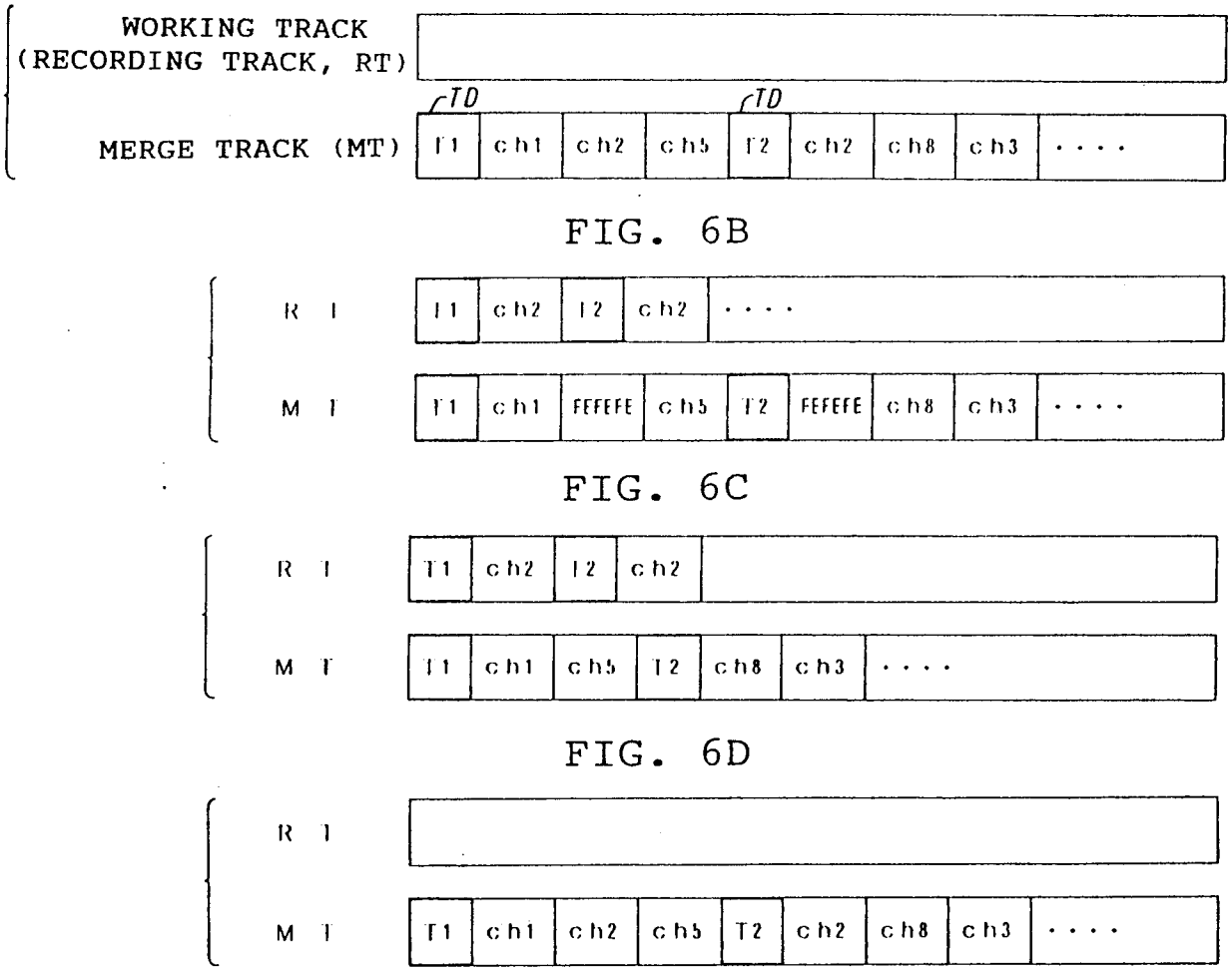
FIGS. 6A through 6D are views showing processes for correcting part of playing information.
Figure 7:
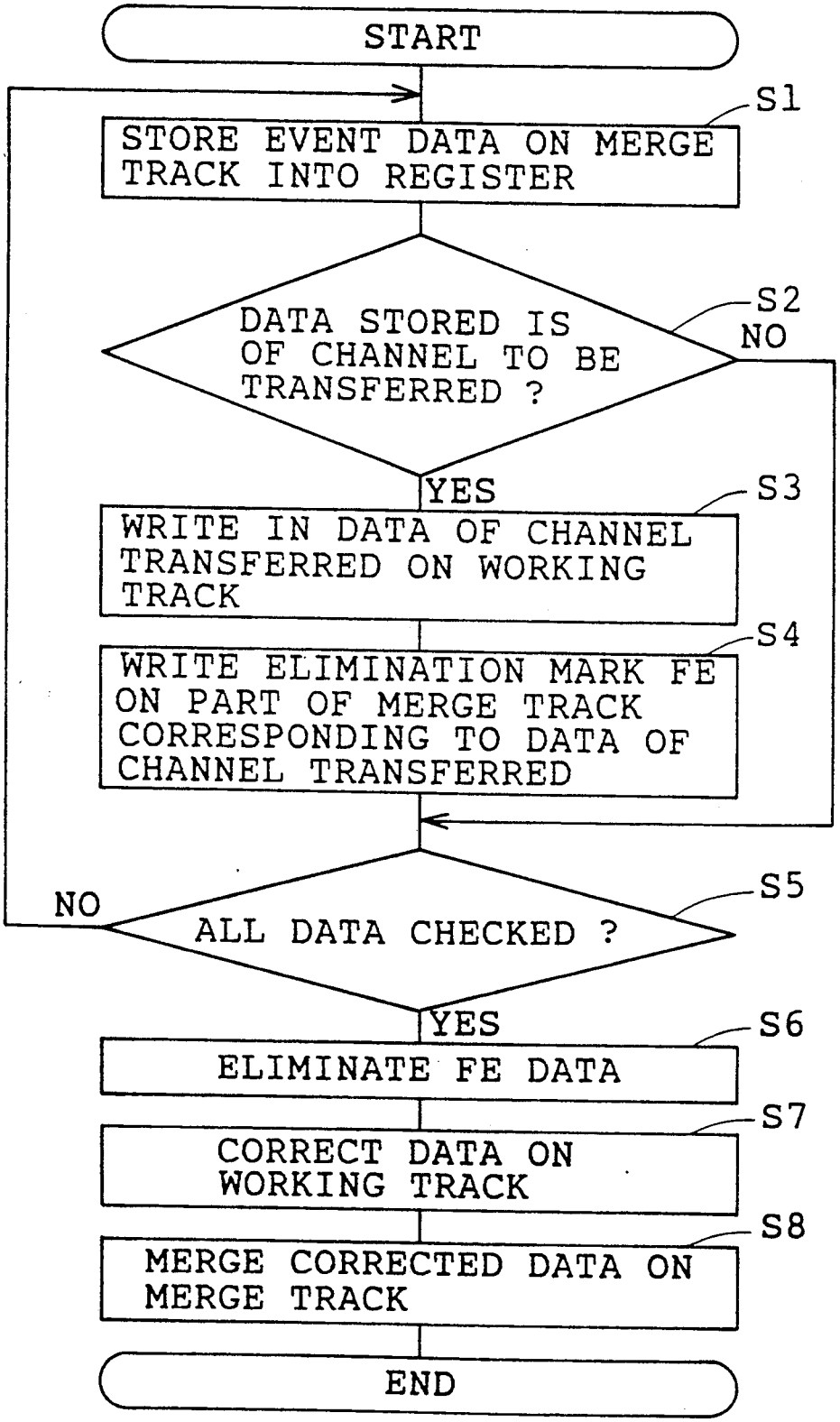
FIG. 7 is a flow chart showing steps for correcting or modifying playing information.

The operation of the MIDI sequencer 1 and the keyboard 11 with MIDI playing information are explained based on views of FIGS. 5A through 5D and FIGS. 6A through 6D, and a flow chart of FIG. 7.

Playing information is recorded and merged in the following manner to complete performance of music.

Playing information for an electronic instrument, e.g., the keyboard 11, is recorded as event data of channel 1 together with corresponding time data TD on a recording track RT in the RAM 1*d* (see FIG. 5A) and is then transferred to a merge track MT (see FIG. 5B). The time data TD, e.g., T1 or T2, is marked at predetermined time intervals. Playing information for another electronic instrument (not shown) is recorded as event data of channel 2 with corresponding time data TD on the recording track RT (see FIG. 5C) and is then transferred to the merge track MT (see FIG. 5D). Now event data of channel 1 and channel 2 are merged on the merge track MT (see FIG. 5D). In the above manner, event data for various electronic instruments are successively merged on the merge track MT to complete performance.

When some correction or modification is required for a specific channel of event data while performance is being recorded, only the event data for the specific channel is transferred back to the recording track RT now used as a working track. For example, only event data of channel 2 is transferred back to the recording track RT from the merge track MT on which event data of channels 1, 2, 3, 5 and 8 are merged as shown in FIG. 6A.

Now steps for correcting or modifying part of playing information are explained with a flow chart of FIG. 7. Data of all the channels recorded on the merge track MT are successively checked. At step Sl, event data on the merge track MT are successively read out and stored into a register corresponding to time data TD like T1 or T2. The program then proceeds to step S2 where it is determined if data stored in the register is of a channel to be transferred for correction or modification (channel 2 in the embodiment) by code data of the lower four bits of the status byte B1 showing various channels.

When data is determined to be of channel 2, the program proceeds to step S3 where the data of channel 2 is written into the working track together with corresponding time data TD as shown in FIG. 6B and also to step S4 where an elimination mark FE is written in all the parts corresponding to data of channel 2 on the merge track MT.

Then at step S5 it is determined if all data is checked in the above manner. When the check is finished for all the data, the program proceeds to step S6 where all the parts with the elimination mark FE on the merge track MT are eliminated as shown in FIG. 6C.

At step S7 data transferred to the working track RT is corrected or modified. While a performance is being reproduced, data of channel 2 is corrected or modified by eliminating data for a certain time period or by recording data again with the function keys 7 and the shift keys 9 of the MIDI sequencer 1.

Then the program proceeds to step S8 where data of channel 2 corrected or modified is merged again on the merge track MT as shown in FIG. 6D and exits from the routine. Only data of channel 2 on the merge track MT has been corrected or modified.

As explained above with the flow chart of FIG. 7, only a specific channel of playing information, i.e., playing information which needs correction or modification, is discriminated from the other channels of playing information merged on the merge track MT, is transferred to the working track RT to be corrected or modified and is then recorded on the merge track MT again. Recording of performance is thus easily and rapidly completed. Further, the embodiment requires only two tracks since the recording track RT also functions as the working track.

The invention is not limited to the above embodiment, but there may be many modifications and changes without departing from the scope of the invention.

Though plural electronic instruments are used and a channel is assigned to each of the instruments in the embodiment, only one electronic instrument may be used and be played many times and a channel may be assigned to each performance.

Every time when specific data is transferred from the merge track MT to the working track RT, the data may be eliminated. Specific data on the merge track MT may not be given the elimination mark FE until its correction is completed. The corrected data may then be written over the old one on the merge track MT. This method has such an advantage that uncorrected data is kept until the end of the correction process.

In the performance recording/reproducing apparatus of the invention, data discrimination means discriminates a specific channel of playing information, which needs correction or modification, from the other channels of playing information all merged on one of the tracks of playing information recording means. Data transfer means transfers playing information of the specific channel discriminated by the data discrimination means from the track storing the playing information to another track. The apparatus thus efficiently corrects or modifies only playing information of the specific channel transferred and accordingly completes recording of performance easily and rapidly.

What is claimed is:

1. A performance recording/reproducing apparatus for recording and editing plural channels of playing information for electronic instruments, comprising:

recording means for recording playing information as event data on at least a record track and a merge track, where the merge track contains plural channels of event data;

reproducing means for reproducing the event data stored in the recording means;

discrimination means for discriminating a channel contained on the merge track from other channels stored on the merge track;

data transfer means for transferring the discriminated channel from the merge track to the record track;

editing means for editing the event data of a specific channel on the record track, the specific channel event data being transferred to the record track by the data transfer means; and merging means for merging the specific channel edited by the editing means with a channel on the merge track.

2. The performance recording/reproducing apparatus of claim 1, in which:

each channel of event data comprises code data for identifying the channel; and the discrimination means discriminates a given channel of event data by determining which of the plural channels of event data stored on the merge track contains the code data for the given channel.

3. The performance recording/reproducing apparatus of claim 2, in which each channel of event data comprises plural data blocks containing data bytes, where a first data byte contains a plurality of channel indicating bits for indicating the channel to which the data block belongs.

4. The performance recording/reproducing apparatus of claim 3, in which the discrimination means discriminates a given channel by comparing the channel indicating bits in each first data byte of each data block with predetermined channel indicating bits for the given channel.

5. The performance recording/reproducing apparatus of claim 3, in which the first data byte further contains an identity bit for identifying the first data byte.

6. The performance recording/reproducing apparatus of claim 5, in which the first data byte further contains a plurality of bits for indicating the status of the operation of the channel.

7. The performance recording/reproducing apparatus of claim 6, in which said data bytes includ a second data byte containing a plurality of bits for determining pitches of sound.

8. The performance recording/reproducing apparatus of claim 7, in which said data bytes include a third data byte containing a plurality of bits for determining volumes of sound.

9. The performance recording/reproducing apparatus according to claim 1, wherein said discrimination means comprises determining means for determining whether event data of a specific channel on the merge track is to beone of corrected and modified, said data transfer means comprising writing means for writing the determined event data on the merge track to the recording track, said apparatus further comprising eliminating means for eliminating the written event data from the merge track.

10. The performance recording/reproducing apparatus according to claim 1, wherein said editing means comprises function keys and shift keys of a MIDI sequencer.

11. A performance recording/reproducing apparatus for recording and editing plural channels of playing information for electronic instruments, comprising:

recording means for recording playing information as event data on at least a record track and a merge track, where the merge track contains plural channels of event data and each channel of event data comprises code data for identifying the channel;

reproducing means for reproducing the event data stored in the recording means; and editing means for discriminating a given channel contained on the merge track from other channels stored on the merge track by determining which of the plural channels of event data stored on the merge track contains the code data for the given channel and for transferring the event data having the code data for the given channel from the merge track to the record track.

12. The performance recording/reproducing apparatus of claim 11, in which each channel of event data comprises plural data blocks containing plural data bytes, where a first data byte contains a plurality of channel indicating bits for indicating the channel to which the data block belongs.

13. The performance recording/reproducing apparatus of claim 12, in which the editing means discriminates a given channel by comparing the channel indicating bits in each first data byte of each data block with predetermined channel indicating bits for the given channel.

14. The performance recording/reproducing apparatus of claim 12, in which the first data byte further contains an identity bit for identifying the first data byte.

15. The performance recording/reproducing apparatus of claim 14, in which the first data byte further contains a plurality of bits for indicating the status of operation of the channel.

16. The performance recording/reproducing apparatus of claim 15, in which said data bytes include a second data byte containing a plurality of bits for determining pitches of sound.

17. The performance recording/reproducing apparatus of claim 16, in which said data bytes include a third data byte containing a plurality of bits for determining volumes of sound.

18. A performance recording/reproducing apparatus for recording and editing plural channels of playing information for electronic instruments, comprising:

input means for receiving playing information represented by event data from one or more electronic instruments;

recording means for storing the event data on at least a record track and a merge track, where the merge track contains plural channels of event data and each channel of event data comprises code data for identifying the channel;

reproducing means for reproducing the event data stored in the recording means;

output means for sending the event data at least one electronic instrument, where the at least one electronic instrument generates sound from the event data; and editing means for discriminating a given channel contained on the merge track from other channels stored on the merge track by determining which of the plural channels of event data stored on the merge track contains the code data for the given channel and for transferring the event data having the code data for the given channel from the merge track to the record track.

19. The performance recording/reproducing apparatus of claim 18, in which each channel of event data comprises plural data blocks containing plural bytes, where a first data byte contains a plurality of channel indicating bits for indicating the channel to which the data block belongs.

20. The performance recording/reproducing apparatus of claim 19, in which the editing means discriminates a given channel by comparing the channel indicating bits in each first data byte of each data block with predetermined channel indicating bits for the given channel.

* * * * *